United States Patent [19]

Schwarz

[11] Patent Number: 4,731,215

[45] Date of Patent: Mar. 15, 1988

[54] PROCESS FOR FORMING NON-WOVEN WEBS FROM HIGHLY ORIENTED MELT BLOWN FIBERS

[75] Inventor: Eckhard C. A. Schwarz, Neehah, Wis.

[73] Assignee: Biax Fiberfilm Corporation, Neenah, Wis.

[21] Appl. No.: 917,186

[22] Filed: Oct. 9, 1986

Related U.S. Application Data

[63] Continuation of Ser. No. 385,903, Jun. 7, 1982, abandoned.

[51] Int. Cl.[4] ..... B29C 47/88

[52] U.S. Cl. ..... 264/517; 156/167; 156/175; 264/230; 264/DIG. 48; 264/DIG. 71

[58] Field of Search ..... 264/503, 518, 567, 230, 264/DIG. 48, 517, DIG. 71, 517; 156/167, 173, 175

[56] References Cited

U.S. PATENT DOCUMENTS

| | | | |
|---|---|---|---|
| 2,972,000 | 2/1961 | Boriolo | 264/230 |
| 3,466,210 | 9/1969 | Wareham | 264/230 |
| 3,801,400 | 4/1974 | Vogt et al. | 156/173 |
| 3,806,289 | 4/1974 | Schwarz | 264/115 |
| 4,032,688 | 6/1977 | Pall | 210/497.1 |
| 4,116,738 | 9/1978 | Pall | 156/167 |
| 4,474,630 | 10/1984 | Planck et al. | 156/175 |

*Primary Examiner*—James Lowe
*Attorney, Agent, or Firm*—Louis E. Marn

[57] ABSTRACT

There is disclosed a process and apparatus for melt blowing at an initial velocity of from 500 to 1000 feet per second a molten thermoplastic condensation polymer at a temperature less than 50° C. above the melting point thereof to form fibers of high molecular orientation, and collecting the fibers to form a non-woven web. In one aspect of the present invention, the fibers are collected on a rotating mandrel and heat treated during collection or subsequent to collection.

6 Claims, 3 Drawing Figures

PROCESS FOR FORMING NON-WOVEN WEBS FROM HIGHLY ORIENTED MELT BLOWN FIBERS

This is a continuation of application Ser. No. 385,903, filed June 7, 1982, and now abandoned.

FIELD OF THE INVENTION

This invention relates to melt-blowing processes, and more particularly to a process and apparatus for forming novel heat shrinkable non-woven webs from highly oriented melt blown thermoplastic fibers.

BACKGROUND OF THE INVENTION

Various melt-blowing processes have been described heretofore including those of Van A. Wente (Industrial and Engineering Chemistry, Volume 48, No. 8 (1956), Buntin et al. (U.S. Pat. No. 3,849,241), Hartmann (U.S. Pat. No. 3,379,811), and Wagner (U.S. Pat. No. 3,634,573) and others, many of which are referred to in the Buntin et al. patent.

Some of such processes, e.g. Hartmann, operate at high melt viscosities, and achieve fiber velocities of less than 100 m/second. Others, particularly Buntin et al. operate at lower melt viscosities (50 to 300 poise) and require severe polymer degradations to achieve optimum spinning conditions. It has been described that the production of high quality melt blown webs requires prior degradation of the fiber forming polymer (U.S. Pat. No. 3,849,241). At an air consumption of more than 20 lb. of air/lb. web substantially less than sonic fiber velocity is reached. It is known, however, that degraded polymer leads to poor web and fiber tensile strength, and is hence undesirable for many applications.

In co-pending application Ser. No. 138,860, filed Apr. 8, 1980 now U.S. Pat. No. 4,380,570, there is disclosed a process and apparatus for extruding through nozzles at high temperatures a molten polymer at low melt viscosity wherein the molten fibers are accelerated to near sonic velocity by gas being blown in parallel flow through small orifices surrounding each nozzle. The products produced thereby as well as in accordance with U.S. Pat. No. 3,849,241 are mostly polyolefins with only nominal molecular orientation. Fibers produced by the prior art melt-blowing processes are weak with unoriented molecular chain structure exhibiting no heat shrinkage characteristics and low values of birefringence.

OBJECTS OF THE INVENTION

It is an object of the present invention to provide a novel apparatus and process for forming novel non-woven webs.

A further object of the present invention is to provide a novel apparatus and process for forming novel heat shrinkable non-woven webs comprised of highly oriented fibers from a thermoplastic condensation polymeric material.

Another object of the present invention is to provide a novel apparatus and process for forming novel heat shrinkable non-woven webs possessing high tension and compression moduli.

Still another object of the present invention is to provide a novel apparatus and process for forming novel heat shrinkable non-woven webs exhibiting bulk retaining properties.

A still further object of the present invention is to provide a novel apparatus and process for forming novel heat shrinkable non-woven webs of a highly bulky web structure.

Yet another object of the present invention is to provide a novel heat shrinkable non-woven web formed of highly oriented fibers and in a highly bulky web structure.

SUMMARY OF THE INVENTION

These and other objects of the present invention are achieved by melt blowing at an initial velocity of from 500 to 1000 feet per second a thermoplastic condensation polymer at a temperature less than 50° C. above the melting point thereof to form fibers of high molecular orientation, and collecting the fibers to form a non-woven web. In one aspect of the present invention, the fibers are collected on a rotating mandrel and heat treated during collection or subsequent to collection.

In another embodiment of the present invention, the molten polymer is passed to the nozzles through a first heating zone at low incremental increases in temperature, and thence rapidly through said nozzles at high incremental increases in temperature to reach the low melt viscosity necessary for high fiber acceleration at short residence time to minimize or prevent excessive polymer degradation.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein like numerals designate like parts throughout; and wherein.

DETAILED DESCRIPTION OF THE PRESENT INVENTION

The thermoplastic polymers which are processed in accordance with the present invention are condensation polymers, such as polyethylene terephthalate, nylon 6,6, etc. i.e. thermoplastic polymers when extruded into fibers by a melt-blowing technique exhibit high thermal shrinkage under specific set of process conditions of high filament extrusion velocity, low melt viscosity, low molecular weight and at spinning temperatures of less than 50° C. above the melting point of the thermoplastic polymer. As described in the hereinabove references, conventional fibers extruded in melt blowing processes are at temperatures above about 150° C. above the crystalline melting point thereof.

The oriented fiber of the present invention are generally not fuse bonded and are essentially continuous. As hereinafter more fully described, the oriented fibers of the present invention are formed into a highly bulky web-like structure. The thus formed bulky web-like structures have many uses, particularly for applications considering structural resistance to compaction pressure, since the oriented fibers have higher tensile and compression moduli than unoriented non-woven webs.

The products of the present invention exhibit excellent thermal insulation properties, and are thus useful in the manufacture of sleeping bags, gloves, winter jackets, pullovers and the like. Additionally, there is useful application based upon the shrink effect of the oriented fibers, e.g. as a filter media. Exposure of the fibers to a temperature above the glass transition temperature of the polymer causes the web density due to the shrink effect to increase by a factor of up to twenty (20), i.e., from about 0.01 to 0.20 grams/cc. Such shrinkage characteristic produces a compact, highly entanged web of unbonded fibers possessing good mechanical strength.

In this connection, several melt-blown cartridge filters have been described in the prior art, but none with advantages of the present invention. Thus, Vogt et al. (U.S. Pat. No. 3,904,798) describes a polypropylene cartridge of self-bonded, continuous fibers. Although, self-bonding increases the rigidity of the cartridge, it detracts from the filtration efficiency by decreasing the open spaces through which the fluid to be filtered can flow. Pall (U.S. Pat. No. 4,032,688) describes a filter cartridge made of unbonded, discontinuous polypropylene fibers (made by a melt-blowing process) spirally wound on a rotating mandrel to keep the tubular web of the unbonded fibers from collapsing.

Figure 1:
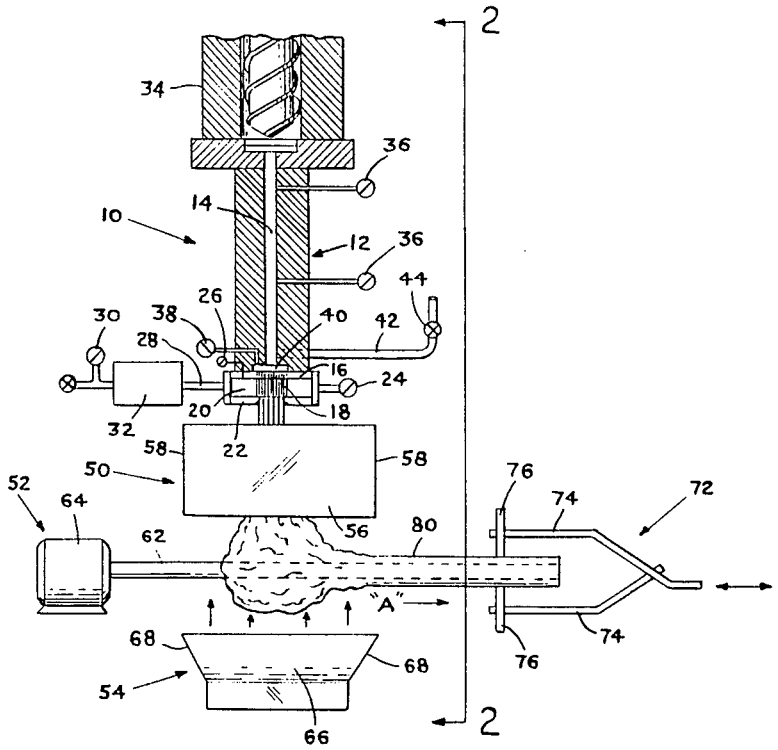
FIG. 1 is a partially schematic cross-sectional elevational view of the apparatus of the present invention.
Figure 3:
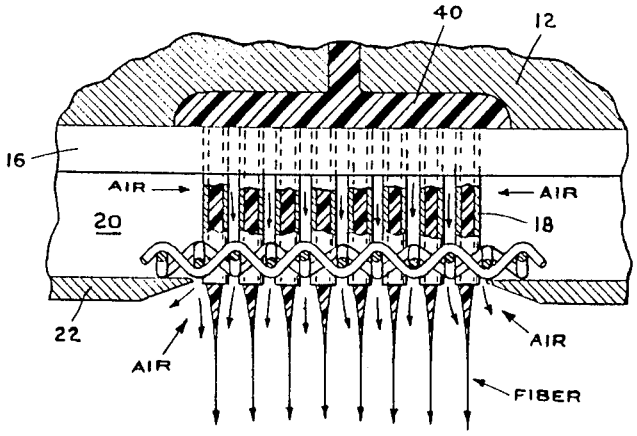
FIG. 3 is an enlarged partial cross-sectional view of the nozzle configuration for such die assembly, taken along the line 2—2 of FIG. 1.

Referring now to FIG. 1, a die, generally indicated as 10, is comprised of a long tube 12 having a chamber 14 connected to a thick plate 16 into which nozzles 18 are inserted through holes in plate 16, and silver solder (not shown) disposed to prevent slippage and leakage. The nozzles 18 extend through an air manifold 20 and through holes in a lower plate 22 in a pattern shown in FIG. 3. The air manifold 20 is provided with an air pressure gauge 24, a thermocouple 26 and an air supply tube 28 which in turn is provided with an in line air flow meter 30 upstream of an air heater 32. Some of the hot air exiting air heater 32 is passed through a jacket (not shown) surrounding tube 12 to preheat a transition zone.

The tubular die 10 is fed with hot polymer from an extruder 34. The tube 12 is provided with thermocouples 36 to measure the polymer melt temperature. A pressure transducer 38 measuring polymer melt pressure is located in a cavity 40 proximate the nozzle inlet. There is provided a resin bleed tube 42 and a valve 44 to bypass resin from the extruder 34 and thus reduce resin flow rate through the nozzles 18. The bleed valve 44 permits adjustment to different temperature and heat transfer patterns in the tube 12 as well as in the nozzles 18.

Figure 2:
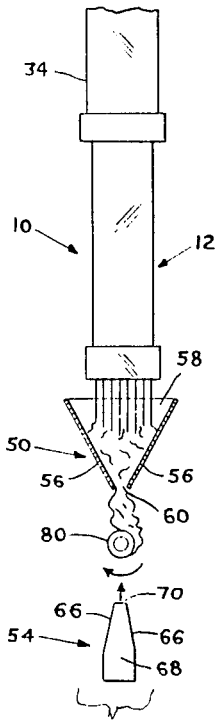
FIG. 2 is a partial side view of the apparatus of FIG. 1.

Beneath the die 10, there is positioned a baffle assembly, a mandrel assembly and an aspirating air assembly, generally indicated as 50, 52 and 54, respectfully. The baffle assembly 50 is comprised of downwardly and inwardly extending side walls 56 and end walls 58, referring specifically to FIG. 2, forming an elongated slot 60 for directing melt blown fibers from the nozzles 18 of the die assembly 10 towards the mandrel assembly 52.

The mandrel assembly 52 is comprised of mandrel 62 mounted for rotation to a shaft of a motor 64. The mandrel 62 of the mandrel assembly 52 is disposed in a plane parallel to and beneath the elongated slot 62 of the baffle assembly 52 for collecting the melt blown fibers, as more fully hereinafter described. The air assembly 54 is comprised of upwardly and inwardly extending side walls 66 and end walls 68 forming an elongated slot 70 for directing a gas, such as air, at a velocity sufficient to cause the melt blown fibers to become highly entangled as the fibers are collected on to mandrel 62. The air stream may be heated as hereinafter discussed.

A cartridge forming assembly, generally indicated as 72, comprised of arm members 74 including rotatable gear elements 76, is provided for continuously moving on the mandrel 62 a compact mass of highly entangled melt blown fiber in cylindrically shaped cartridge form during collection of the fibers.

In operation, a condensation polymer of an intrinsic viscosity of less than 0.6 is heated to a temperature of less than 50° C. above the melt temperature and is extruded through nozzle 18 towards the baffle assembly 52. As the melt blown fibers drop through the slot 60, the melt blown fibers are contacted with gaseous stream at ambient temperature or at a temperature sufficient to heat the fibers to a temperature of from 70° to 265° C. and at an initial velocity of from 500 to 1000 feet per second to cause the melt blown fibers to form a highly entangled web of unbonded fibers which are gathered on the rotating mandrel 62 rotating at an angular velocity of 5 to 500 revolution per minute, preferably 10 to 250 per minute.

A cartridged-shaped mass 80 is formed about the mandrel 62 to a radial thickness of from about ¾ to 5 inches, which cartridge d-shape mass maybe continuously urged from left to right, as illustrated by the arrow "A", by the collection assembly 72, or alternately moved back and forth until a desired thickness is attained.

EXAMPLES OF THE INVENTION

Operation of the process is described in the following Examples which are intended to be merely illustrative, and the invention is not to be regarded as limited thereto. It will be shown that the cartridges of the present invention are comprised of unbonded, continuous melt-blown filaments of condensation polymers compacted to a high density by the shrinkage effect, that high mechanical rigidity is obtained without self-bonding, and that filtration efficiency is not decreased by bonding.

The melt-blowing die assembly used in the following Examples is comprised of four rows of nozzles 18 with 50 nozzles per row. In such assembly, a screen, having the same spacing as the extrusion nozzles is used to form four air orifices around each extrusion nozzle. (See FIG. 3.) The capillary arrangement had the following dimensions: length of capillary-1.27 cm; inside diameter-0.03302 cm; outside diameter, 0.0635 cm; distance between capillaries, center to center: 0.1058 cm:

Apparent Melt Viscosity is calculated from Poisseuille's equation:

$$Q = \frac{\pi p r^4}{8 C \eta}$$

wherein:

Q=polymer flow through a single nozzle (CC/sec)
p=polymer pressures (dynes/cm.$^2$)
r=inside nozzle radius (cm.)
l=length of capillary (cm.), and
$\eta$=apparent melt viscosity (poise)

To calculate Q (cc/sec) from the polymer flow rate measured in gram/minutes, the following densities of the solid polymer have been used: 1.36 gram/cc for polyester, and 1.15 gram/cc for nylon 6,6. The term "intrinsic viscosity" (IV), as used herein, is defined as the limit of the fraction ln(r)/C, as C approaches zero, where (r) is the relative viscosity, and C is the concentration in grams per 100 ml. of solution. The relative viscosity (r) is the ratio of the viscosity of a solution of a polymer to the viscosity of the pure solvent per se, measured in the same units at 25° C. Intrinsic viscosity is a measure of the molecular weight of a polymer.

For polyethylene terephthalate (polyester), a solvent mixture of one part trifluoroacetic acid and three parts of methylene chloride (by volume) is used, for nylon 6,6 (polyhexamethylene adipamide), ortho-cresole is used.

Fiber diameter is an average value obtained by optical or stereoscan electron microscopy.

Fiber velocity is calculated by:

$$V = \frac{Q(\text{g/sec})}{\text{fiber cross section area} \times d}$$

For these calculations, the density d(g/cc) of the solid polymer has been used.

$$\%\ \text{Shrinkage} = \frac{l_o - l_t}{l_o} \times 100,$$

wherein $l_o$=length of a dissected filament as initially extruded.

$l_t$=length of the filament after heating for 15 seconds at 120° C.

Birefringence is the difference of the refractive indices parallel and vertical to the fiber axis.

0.50; and Type C of 0.65. The extruder (1" screw diameter, L/D ratio 24/1) is provided with threeheating zones; the hopper (inlet) zone was heated to 265° C., the middle zone to 285° C. and the outlet zone to 295° C. Heated air is passed to the die at 25 psg pressure, the temperature was varied and measured in the air cavity i.e., extrusion temperature. The die block temperature equilibrates with the air temperature after a few minutes of extrusion. The following Table I lists the results:

TABLE I

Melt-Blowing of Shrinkable Polyester (PET)

| Resin Type | Run # | Extrusion Temperature (C.) | Polymer Flow Rate (lb/hr) | Polymer Pressure (psi) | AMV (Poise) | I.V. (Fiber) | Fiber diameter (Micron) | Fiber Velocity (m/sec.) | % Shrinkage | Birefringence |
|---|---|---|---|---|---|---|---|---|---|---|
| A | 1 | 320 | 3.17 | 2 | 3 | 0.32 | 1.8 | 579 | 60 | |
| A | 2 | 300 | 3.17 | 5.3 | 6 | 0.32 | 2.0 | 469 | 82 | 0.1200 |
| A | 3 | 290 | 2.91 | 21 | 25 | 0.33 | 2.6 | 254 | 39 | |
| A | 4 | 285 | 2.64 | 35 | 45 | 0.35 | 3.2 | 153 | 21 | |
| A | 5 | 320 | 27.8 | 32 | 4 | 0.33 | 5.7 | 510 | 52 | |
| A | 6 | 300 | 29.1 | 68 | 8 | 0.33 | 6.2 | 440 | 70 | 0.0850 |
| A | 7 | 290 | 29.1 | 255 | 30 | 0.34 | 9.3 | 220 | 34 | |
| A | 8 | 285 | 29.1 | 382 | 45 | 0.34 | 12.5 | 110 | 19 | |
| B | 9 | 320 | 2.91 | 34 | 40 | 0.45 | 2.9 | 200 | 29 | |
| B | 10 | 300 | 2.91 | 47 | 55 | 0.45 | 3.8 | 120 | 24 | |
| B | 11 | 290 | 2.65 | 59 | 76 | 0.46 | 4.7 | 70 | 20 | |
| B | 12 | 285 | 2.65 | 70 | 91 | 0.47 | 5.3 | 55 | 10 | 0.0065 |
| C | 13 | 320 | 3.17 | 59 | 64 | 0.60 | 39 | 125 | 13 | |
| C | 14 | 300 | 3.17 | 71 | 83 | 0.60 | 52 | 71 | 5 | |
| C | 15 | 290 | 3.17 | 89 | 96 | 0.60 | 73 | 36 | 0 | 0.008 |

Run #2 (low molecular weight resin, at 6 poise apparent melt viscosity 300° C. extrusion temperature) exhibited the highest shrinkage value. At higher extrusion temperature, the molecular orientation of the polymer induced by the high spinning velocity, has more time to de-orient in the melt phase since cooling of the fiber takes longer. At lower extrusion temperatures, shrinkage also decreases, as melt viscosity increases and fiber velocity decreases. The same effects are seen in Runs 5 through 8, which is nearly identical to Runs 1 through 4, except that resin throughput is increased and fiber diameters are correspondingly larger. Using resins of higher molecular weight (Type B and C) shows the effect of higher apparent melt viscosities (=AMV) and lower fiber velocities leading to lower shrinkage values.

EXAMPLE II

Two types of textile grade nylon 6,6, DuPont's "Zytel" TE, (Type D=0.45 IV, and Type E=0.80 IV) were melt-blown under conditions described in Example I. The results are listed in Table II, below as Runs 1 through 7.

TABLE II

Melt-Blowing of Shrinkable Nylon 6,6

| Resin Type | Run # | Extrusion Temperature (C.) | Polymer Flow Rate (lb/hr) | Polymer Pressure (psi) | AMV (Poise) | I.V. (Fiber) | Fiber diameter (Micron) | Fiber Velocity (m/sec.) | % Shrinkage | Birefringence |
|---|---|---|---|---|---|---|---|---|---|---|
| D | 1 | 320 | 3.25 | 12 | 11 | 0.38 | 2.1 | 511 | 45 | |
| D | 2 | 300 | 3.25 | 20 | 18 | 0.38 | 2.4 | 391 | 72 | |
| D | 3 | 290 | 3.14 | 34 | 31 | 0.40 | 3.4 | 194 | 37 | |
| D | 4 | 285 | 3.14 | 53 | 48 | 0.41 | 5.2 | 83 | 18 | |
| E | 5 | 320 | 2.75 | 69 | 75 | 0.74 | 7.5 | 33 | 0 | |
| E | 6 | 300 | 2.75 | 84 | 92 | 0.74 | 12 | 13 | 0 | |
| E | 7 | 290 | 2.65 | 97 | 107 | 0.76 | 14 | 10 | 0 | |

EXAMPLE I

Three types of dried polyethylene terephthalate resin, (A, B, and C) are extruded respectively, through the hereinabove described melt-blowing system. Type A had an initial intrinsic viscosity of 0.38; Type B of The shrinkage effects are similar as for polyester. About 300° C. % shrinkage decreases again for low molecular weight resin, and decreases also as fiber velocities decrease at the lower temperatures. The high molecular weight resin (Type E) showed almost no shrinkage due to high AMV and low fiber velocities.

EXAMPLE III

Very low molecular weight polypropylene of 150 gram/10 minutes Melt Flow Rate and a crystalline melting point of 160° C. is processed in the melt-blowing system described in Example I. The extruder zones are heated to 210° C. No fibers formed at an extrusion temperature of 210° C. due to too high a melt viscosity. At high extrusion temperatures of 260° degree C. to 300° C., fibers formed but exhibited no shrinkage upon heating to 125° C.

Polyester of Type A (Example I) is melt blown through the apparatus described in FIG. 1, under conditions of Example I, Run #2, and collected on a rotating mandrel rod of ¾ inch diameter and 12 inch length dispersed 18 inches below the nozzle die. The mandrel was driven at 120 RPM. The baffle assembly 52 is placed between the die and the mandrel 62 to direct all fibers onto the rotating mandrel 62. The fibers having a velocity immediately below the die of about 470 meter/-second entangled to a fluffy, bulky web at the lower part of the baffle assembly 52. This web is then pulled down by the rotating mandrel and wrapped around it. The mandrel is moved from one end to the other to cover all 12 inches with a fiber sleeve. After 3 minutes of collecting, a tubular sleeve about the mandrel 62 is grown to 3 inches in diameter. The fiber sleeve is slipped off the rod. The tubular cartridge, comprised of continuous, unbonded fibers, is soft, could be easily bent and collapsed by hand, and had a density of 0.055 gram/cc.

EXAMPLE IV

Another tube was prepared (72 grams, 3 inch diameter), as per Example III, and a hot stream of air at a temperature of about 200° C. is directed on to the rotating fiber covered mandrel. Within about 3 seconds, the fiber sleeve had shrunk to a diameter of 1.75 inches at a density of 0.186 gram/cc. The tube, after being slipped off the rod is firm and rigid, and withstood without collapsing a vertical pressure to its axis of 1.2 lb/linear inch.

EXAMPLE V

In this Example a hot air stream is directed onto the mandrel 62 while the fiber web is collected on the mandrel 62 thereby simultaneously performing spinning, collecting and shrinking. After 3 minutes, the fiber sleeve is built up to a diameter of 1.6 inches at a density of 0.23 gram/cc. The tube could withstand without collapsing a pressure of 2 lb/linear inch.

EXAMPLE VI

Example V was repeated using extrusion conditions of Table 1, Run #6 (200 gram/minute throughput). After 18 seconds, the tube is built up to a diameter of 1.75 inch at a density of 0.19 gram/cc. The tube exhibited a porosity of 86%, where $$\% \text{ porosity} = 1 - \frac{\text{bulk density of cartride}}{\text{density of fiber}} \times 100$$

The tube could withstand a pressure vertical to its axis of 1.8 lb/linear inch, and is comprised of unbonded, continous, highly entangled fibers.

EXAMPLE VII

A fiber web is collected on the 12 inch rod (as described in Example VI). After formation to a diameter of about 1.75 inch, the web sleeve is built up on the free end of the rod, the rotating tube is gripped with the clamping device pressed against the sleeve, and pulled away at a rate of about 3 feet per minute. A continuous tube of a density of 0.2 gram/cc, an inside diameter of 0.75 inch and outside diameter of 1.75 diameter is thus continuously formed. Example VII demonstrates continuous spinning, collecting, shrinking and withdrawal of a continuous tube.

While the present invention has been described with reference to a melt blowing die assembly wherein the fibers are formed at sonic velocity, it is to be understood to one skilled in the art that any melt blowing die assembly may be used in the present invention.

While the present invention has been described in connection with an exemplary embodiment thereof, it will be understood that many modifications will be apparent to those of ordinary skill in the art and that this application is intended to cover any adaptation or variation thereof. Therefore, it is manifestly intended that this invention be only limited by the claim and the equivalents thereof.

I claim:

1. A process for producing a tubular sleeve of nonwoven fibers, which comprises:

(a) heating a thermoplastic condensation polymer selected from the group consisting of polyethylene terephthalate and nylon 6,6 to a molten state to a temperature sufficient to attain an apparent melt viscosity of less than 50 poise;

(b) spinning by melt blowing said molten thermoplastic condensation polymer in the presence of a first gaseous medium heated to melt blowing conditions to form oriented, heat shrinkable, melt blown fibers, said melt blown fibers exhibiting a shrinkage of at least about 19%;

(c) collecting said melt blown fibers on a rotating mandrel to form a loose tubular sleeve of said oriented melt blown fibers;

(d) contacting said tubular sleeve with a second gaseous medium heated to a temperature of from 70° to 265° C. to thereby shrink and entangle said melt blown fibers and form a rigid cartridge having a density of at least 0.1 gram/cc; and (e) removing said cartridge from said rotating mandrel.

2. The process as defined in claim 1 wherein said gaseous medium is air.

3. The process as defined in claim 1 wherein steps (b), (c), and (d) are effected simultaneously.

4. The process as defined in claim 3 wherein said rotating mandrel is moved laterally during steps (b), (c), and (d).

5. The process as defined in claim 1 wherein said cartridge is continuously removed from said rotating mandrel.

6. The process as defined in claim 1 wherein said cartridge is cut into segments.

* * * * *